US009040864B2

(12) United States Patent
Kharade

(10) Patent No.: US 9,040,864 B2
(45) Date of Patent: May 26, 2015

(54) PROFILED ARC SPLITTER PLATE

(71) Applicant: ASCO Power Technologies, L.P., Florham Park, NJ (US)

(72) Inventor: Varsha Kundalik Kharade, Ahmendnagar (IN)

(73) Assignee: ASCO Power Technologies, L.P., Florham Park, NJ (US)

( * ) Notice: Subject to any disclaimer, the term of this patent is extended or adjusted under 35 U.S.C. 154(b) by 47 days.

(21) Appl. No.: 14/016,051

(22) Filed: Aug. 31, 2013

(65) Prior Publication Data

US 2014/0346146 A1 Nov. 27, 2014

(30) Foreign Application Priority Data

May 27, 2013 (IN) ..... 1864/MUM/2013

(51) Int. Cl.
*H01H 9/44* (2006.01)
*H01H 9/36* (2006.01)

(52) U.S. Cl.
CPC ..... *H01H 9/36* (2013.01)

(58) Field of Classification Search
CPC ..... H01H 73/18; H01H 9/34; H01H 9/302; H01H 2009/365
USPC ..... 218/23, 149
See application file for complete search history.

(56) References Cited

U.S. PATENT DOCUMENTS

| | | | | | |
|---|---|---|---|---|---|
| 3,997,746 | A * | 12/1976 | Harper et al. | ..... | 218/149 |
| 4,144,513 | A * | 3/1979 | Shaffer et al. | ..... | 335/46 |
| 4,420,660 | A * | 12/1983 | Hisatsune et al. | ..... | 218/149 |
| 4,451,718 | A * | 5/1984 | Yamagata et al. | ..... | 218/23 |
| 4,524,339 | A * | 6/1985 | Chabot | ..... | 335/22 |
| 4,743,720 | A * | 5/1988 | Takeuchi et al. | ..... | 218/24 |
| 4,970,482 | A * | 11/1990 | Jacobs et al. | ..... | 335/201 |
| 5,260,533 | A * | 11/1993 | Livesey et al. | ..... | 200/401 |
| 5,579,198 | A * | 11/1996 | Wieloch et al. | ..... | 361/93.6 |
| 5,898,152 | A * | 4/1999 | Kim | ..... | 218/149 |
| 6,573,815 | B1 * | 6/2003 | Tsukima et al. | ..... | 335/202 |
| 7,674,996 | B2 * | 3/2010 | Shea et al. | ..... | 218/34 |
| 7,705,263 | B2 * | 4/2010 | Rane et al. | ..... | 218/149 |
| 8,803,021 | B2 * | 8/2014 | Noisette et al. | ..... | 218/149 |
| 8,822,866 | B2 * | 9/2014 | Fasano | ..... | 218/22 |

* cited by examiner

*Primary Examiner* — Truc Nguyen
(74) *Attorney, Agent, or Firm* — McDonnell Boehnen Hulbert & Berghoff LLP

(57) ABSTRACT

A profiled arc splitter plate for a switch having a fixed contact and a movable contact is provided to increase electromagnetic attractive forces on the arc generated during contact separation. The plate (300) comprises a body (306) defining an operatively inverted substantially V-shaped recess having a center notch (302) provided at the vertex of the recess and at least one protrusion (304) defined on either side of the center notch (302) along the inclined side walls of the recess, the movable contact of the switch displaceable through the recess without contacting the inclined side walls, in a spaced apart manner from the protrusions (304) and the center notch (302). Chamfers 308 are provided at an end of the plate (300) proximal to the vertex of the recess to provide an exit for hot gases towards the vent of the arc chamber.

6 Claims, 5 Drawing Sheets

PROFILED ARC SPLITTER PLATE

FIELD OF THE DISCLOSURE

The present disclosure relates to electrical switching devices.

DEFINITION

The expression 'switch' or 'switching device' used hereinafter in the specification refers to but is not limited to electrical devices including transfer switches, circuit breakers, protection devices and related switchgear products.

This definition is in addition to that expressed in the art.

BACKGROUND

Switching devices are typically intended to provide a continuous power supply to a motor or an electrical load and associated circuitry.

Switching devices divert or switch power from its primary/intended electrical power source to a secondary/emergency source of power in the event of loss of primary power.

Overload switching generally occurs when switching power to a motor and almost 6-10 times rated current is observed. After physical separation of the contacts of a switch, high current continues to flow through a channel of hot ionized plasma, namely the arc. An arc erodes the contact material and hence reduces the life of a switch.

The severity of the arc increases with the current level. To reduce erosion and damage to switches, the arc should be quenched very fast. Splitter plates are provided in the arc chamber for this purpose. Splitter plates known in the art have a single center notch. The plates are stacked parallel to each other and vertically in the same plane as the contacts of the switches. To quench the arc, an arc chamber consisting of a stack of splitter plates structured to break up the generated arc is provided. When the movable electrical contact is separated from the fixed contact, an arc is generated and is pulled into the arc chamber due to electromagnetic forces. The arc gets elongated, and then splits into a series of several arcs and the arc voltage starts increasing. When the arc voltage is greater than the system voltage, it leads to arc quenching. Splitter plates also help in cooling of the arc.

Due to cooling, the arc diameter reduces, which in turn increases the arc resistance. This helps in arc extinction.

Conventionally, splitter plates are designed with only one notch at the center. The conventional structure and arrangement of splitter plates is associated with many limitations. One such limitation is the travelling distance of the arc from the electrical contacts to the center notch, which is very large. Due to the large travelling distance, arcing time increases which subsequently increase erosion of the tips of the electrical contacts. Due to increased arcing time, the thermal stress on the arc chamber and the entire switch also increases. The magnetic material of the splitter plates in the vicinity of the arc chamber is also less due to which electromagnetic force exerted on the arc is less, which is a highly unfavorable condition for extinguishing the arc.

Therefore, there is felt a need to provide an efficient and improved splitter plate to reduce total arcing time by increasing electromagnetic attractive forces, thereby improving electrical life of a switching device.

OBJECTS

Some of the objects of the present disclosure which at least one embodiment is adapted to provide, are described herein below:

It is an object of the present disclosure to ameliorate one or more problems of the prior art or to at least provide a useful alternative.

Another object of the disclosure is to provide an arc splitter plate that provides increased electromagnetic forces on the arc.

Yet another object of the disclosure is to provide an arc splitter plate that reduces arcing time.

Still another object of the disclosure is to provide an arc splitter plate having an optimized and compact profile.

An additional object of the disclosure is to provide an arc splitter plate that provides enhanced cooling of the arc column.

Yet another object of the disclosure is to provide an arc splitter plate that improves the electrical life of a switch.

A further object of the disclosure is to provide an arc splitter plate that is cost effective.

Other objects and advantages of the present disclosure will be more apparent from the following description when read in conjunction with the accompanying figures, which are not intended to limit the scope of the present disclosure.

SUMMARY

In accordance with one aspect of the present disclosure, there is provided a profiled arc splitter plate for a switch having a fixed contact and a movable contact having width W1, the plate comprising:

a body having a length L1 being a distance between a first set of two parallel planes defined at a proximal end and a distal end respectively with reference to the movable contact, and width W4 being a distance between a second set of two parallel planes, each plane of the second set being perpendicular to the planes of the first set, the body defining an operatively inverted substantially V-shaped recess having a center notch with diameter D in the range 2-4 mm, provided at the vertex of the recess, the vertex located at a distance L2 from the plane of the first set defined at the proximal end and a distance L3 from the plane of the first set defined at the distal end, the distance L1 being in the range 75-80% of the length L1, the distance L3 being in the range 20-25% of the length L1; and a first protrusion and a second protrusion defined on either side of the center notch along the inclined side walls of the recess, at a distance L4 and L5 respectively from the plane of the first set defined at the proximal end, the distance L4 being in the range 25-30% of the length L1 the distance L5 being in the range 60-65% of the length L1, the movable contact of the switch displaceable through the recess without contacting the inclined side walls, in a spaced apart manner from the protrusions and the center notch, a clearance CL between the inclined side walls and the tip of the movable contact being in the range 3-4 mm and distance W2 being the maximum distance between the inclined side walls in the range 75-80% of the width W1.

Typically, in accordance with the present disclosure, the location of the vertex of the recess and accordingly the location of the center notch is adapted to increase effective magnetic material in the vicinity of the arc column of the switch and provide predetermined clearance between the plate and the movable contact.

Optionally, in accordance with the present disclosure, the plate is provided with chamfers at an end proximal to the vertex of the recess.

Typically, in accordance with the present disclosure, the plate has a profile corresponding to the shape and geometry of the profile of at least one of arc runner, movable contact and tips of the movable contact.

Furthermore, in accordance with the present disclosure, the plate has a profile corresponding to at least one parameter selected from the group consisting of switch rating, short circuit rating of the switch, overload rating of the switch, saturation of magnetic flux lines during faults, location of the center notch and cooling of hot gases and arc column.

Typically, in accordance with another aspect of the present disclosure, an arc chute comprises at least one stack of profiled splitter plates, each profiled splitter plate as disclosed herein above.

BRIEF DESCRIPTION OF ACCOMPANYING DRAWINGS

A profiled arc splitter plate of the present disclosure will now be described with the help of accompanying drawings, in which.

DETAILED DESCRIPTION

The profiled arc splitter plate of the present disclosure will now be described with reference to the embodiments which do not limit the scope and ambit of the disclosure.

The embodiments herein and the various features and advantageous details thereof are explained with reference to the non-limiting embodiments in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Conventional splitter plates used in electrical switching devices are not effective in quenching arcs in a timely manner. The present disclosure envisages a profiled splitter plate to increase electromagnetic attractive forces on the arc and hence reduce the total arcing time. With these improvements the switch can sustain higher level current and provide better performance.

The splitter plates of the present disclosure will now be explained with reference to FIGS. 1 to 7 wherein key components are generally referenced by numerals as illustrated.

Figure 1:
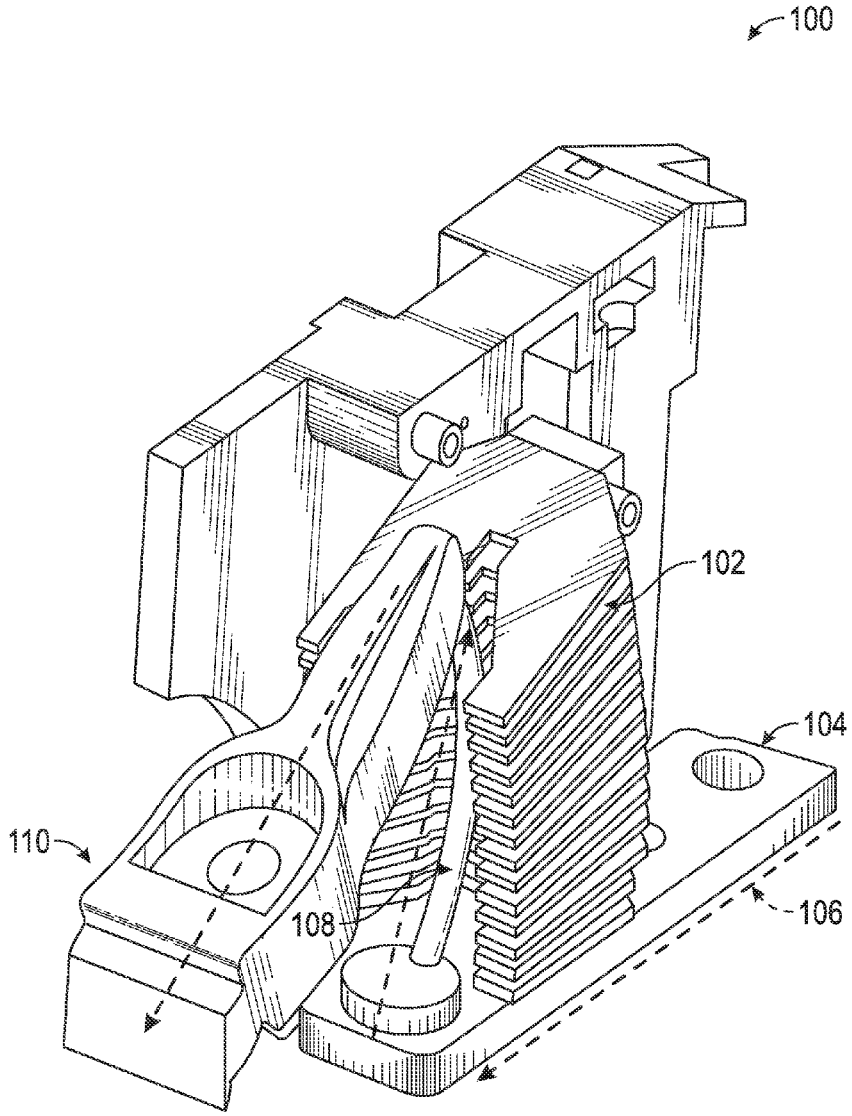
FIG. 1 illustrates splitter plates and arc chamber assembly in a switching device.

FIG. 1 illustrates splitter plates 102 and an arc chamber assembly (not particularly indicated) in a switching device 100 having a movable contact 110 and a fixed contact 104. An arc column 108 occurs when electricity flows via ionized air molecules or vaporized metal and results in damage to the contacts (110, 104). The dashed line 106 represents current path during arcing.

Figure 2:
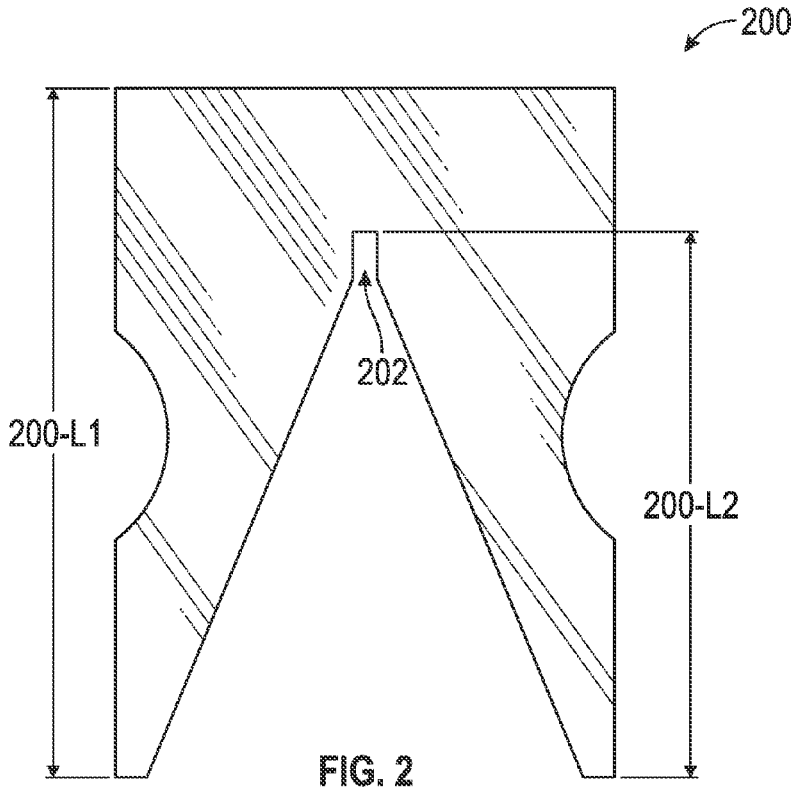
FIG. 2 (Prior Art)
FIG. 2 illustrates a splitter plate known in the art.

FIG. 2 illustrates a splitter plate 200 known in the art. The splitter plate 200 has only one notch 202 at the center. The length of the conventional splitter plate 200, generally referenced as 200-L1, is typically 1.98 inch and the distance of the notch 202 from the end proximal the movable contact, generally referenced as 200-L2, is typically 1.57 inch. The limitation of the conventional splitter plate 200 is that the arc travelling distance from the contacts to the center notch 202 is large. This leads to an increase in arcing time and hence the erosion of the contact tips and stresses on the switching system. The magnetic material of the splitter plate in the vicinity of the arc column is also less and therefore the electromagnetic force exerted on the arc is less. This is not a favorable condition for extinguishing the arc.

Figure 3:
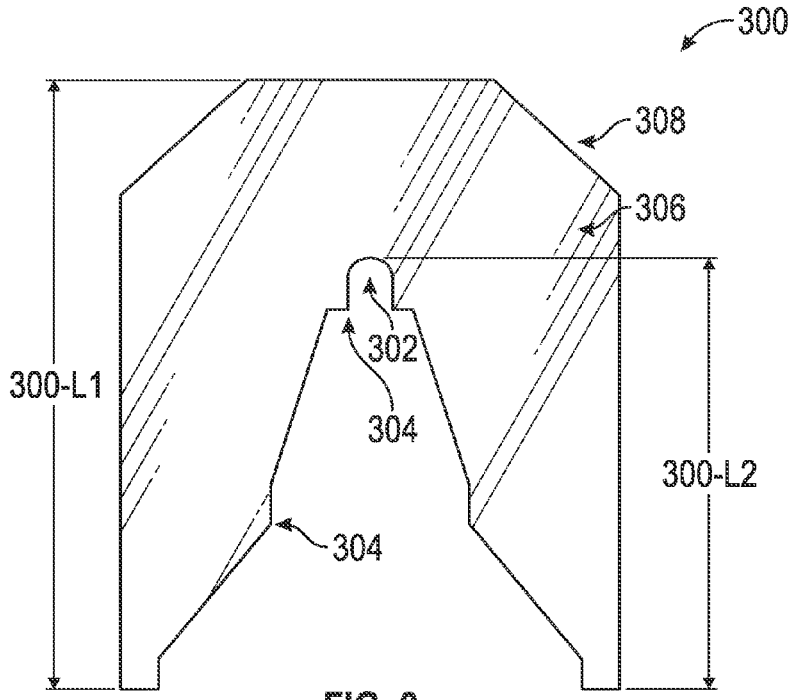
FIG. 3 illustrates a profiled arc splitter plate in accordance with an embodiment of the present disclosure.

FIG. 3 illustrates a profiled arc splitter plate 300, for a switch having a fixed contact and a movable contact, in accordance with an embodiment of the present disclosure. The splitter plate 300 comprises a body 306 that defines an operatively inverted substantially V-shaped recess. The recess is further provided with a center notch 302 at the vertex of the recess and at least one protrusion defined on either side of the center notch 302 along the inclined side walls of the recess. FIG. 3 particular shows two protrusions 304 defined on either side of the center notch 302 such that effective magnetic material in the vicinity of the arc column or towards the axis of symmetry of the plate is increased. This modification considerably increases the attracting forces on the arc. The center notch 302 is shifted nearer to the movable contact and hence the arc column. This reduces the arc travel and therefore the run time from the contact tip to the arc chamber. The length of the splitter plate 300, generally referenced as 300-L1, is typically 1.37 inch and the distance of the center notch 302 from the end proximal the movable contact, generally referenced as 300-L2, is typically 1.05 inch.

An arc chute typically comprises at least one stack of arc splitter plates. In accordance with an aspect of the present disclosure, the profile of all the profiled arc splitter plates in an arc chute is the same except that two plates at the bottom of the stack have thickness of 0.078 inch. The remaining plates have a thickness of 0.059 inch. Due to higher thickness of the bottom plates, at the initial stage of opening of the contacts the forces exerted on the arc are higher so that arc can quickly move from the contact tips to arc chute and the erosion of the tips is minimized. The total height of the stack is also less as compared to conventional arc chutes. It is optimized in such a way that there is no saturation of the plates and it also provides sufficient cooling for the arc. The reduced height of stack allows the arc chute and accordingly the switch to be compact. Chamfers 308 are provided at an end of the plate proximal to the vertex of the recess to provide an exit for hot gases towards the vent of the arc chamber.

Simulation results on profiled arc splitter plates as disclosed herein above show that there is approximately a 70% increase in electromagnetic forces on the arc when compared with splitter plates known in the art.

The parameters that determine the shape/profile of the arc splitter plate in accordance with the present disclosure are:

saturation of magnetic flux lines during high current faults;
switch rating, short circuit/overload rating of the switch;
location of center notch; and
cooling of hot gases and arc column.

Saturation of Magnetic Flux Lines During High Current Interruption

During high current interruption, as high magnitude current passes through a switching system, electromagnetic field is created in the vicinity of the movable/fixed contacts of the switching device. The flux lines pass through a minimum reluctance/reactance path offered by the arc splitter plates, which are typically made of steel.

To avoid saturation of the plates, splitter plates having maximum possible length is desirable, but it increases the overall size of the arc chute, switch and copper material used for the fixed contact. With repeated experimentation and trials, the saturation levels of the plates are verified and the length of the splitter plate is optimized. Beyond a specific length of the plate there will not be an increase in force on the arc with a corresponding increase in length. In accordance with an embodiment, the force does not increase considerably when the splitter plate length is increased above 1.3 inch.

The profiled arc splitter plates of the present disclosure is thus structured such that the plates are not saturated by ensuring that maximum flux lines pass through the plates so that maximum electro-magnetic attracting force is exerted on the arc column.

Location of the Center Notch

This is one of the most important features in the structure of splitter plates. There is a considerable increase in force by placing the center notch near the contact tips since it increases the effective magnetic material in the vicinity of the arc column which reduces the arc travel distance and the arcing time and it reduces the thermal stress developed in the system and the erosion of the contacts. With the profiled arc splitter plate of the present disclosure, the distance of the center notch from the end proximal the movable contacts is noticeably reduced from 1.57 inch (distance 200-L2 illustrated in FIG. 2) to 1.05 inch (distance 300-L2 illustrated in FIG. 2) and the force is increased by 25-30% when compared to conventional splitter plates.

Cooling of Hot Gases and Arc Column

The portion of the body of splitter plates behind the center notch or the body portion typically extending from the center notch to the end of the plate distal from the movable contact helps in cooling of hot gases and the arc column.

Accordingly, when finalizing the total length of the profiled arc splitter plate and the location of the center notch, in accordance with the present disclosure, the distance from the center notch to the end of the plate distal from the movable contact is verified so that sufficient cooling is provided. This also ensures that there is sufficient material for arc quenching and cooling during multiple high current interruptions.

Figure 4:
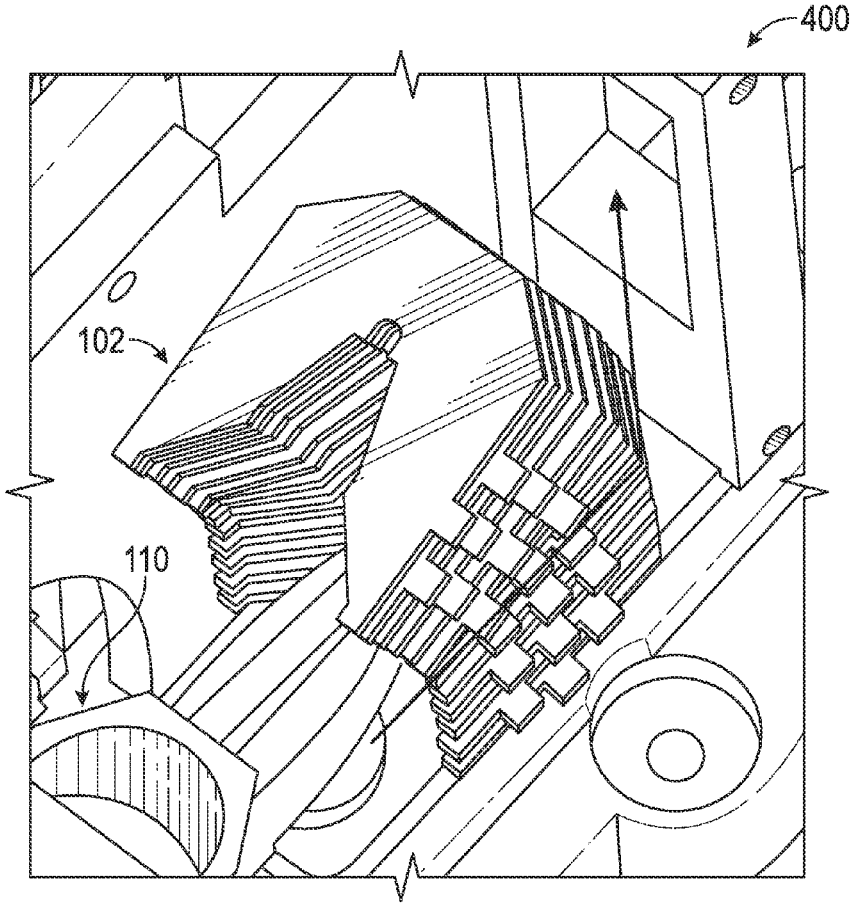
FIG. 4 illustrates direction of escape of hot gases from the arc chamber assembly using profiled arc splitter plates, in accordance with the present disclosure.

The bold arrow line in FIG. 4 illustrates the direction of escape of hot gases from the arc chamber assembly using profiled arc splitter plates, in accordance with the present disclosure.

During the initial stage of high current interruption, the arc gets generated between the contact tips of the movable and fixed contacts as these contacts open due to repulsive Holm's forces. The contact tips are typically of silver material. The arc stays there for a length of time generally referred in the art as arc immobility time. During this initial stage, couple of splitter plates at the bottom of the stack can only exert pulling force on the arc. Accordingly, to minimize erosion of contacts there is a need to provide sufficient space for easy escape of hot gases and fast cooling of the arc column. Chamfers 308 (shown in FIG. 3) are provided as venting windows to aid this.

Figure 5:
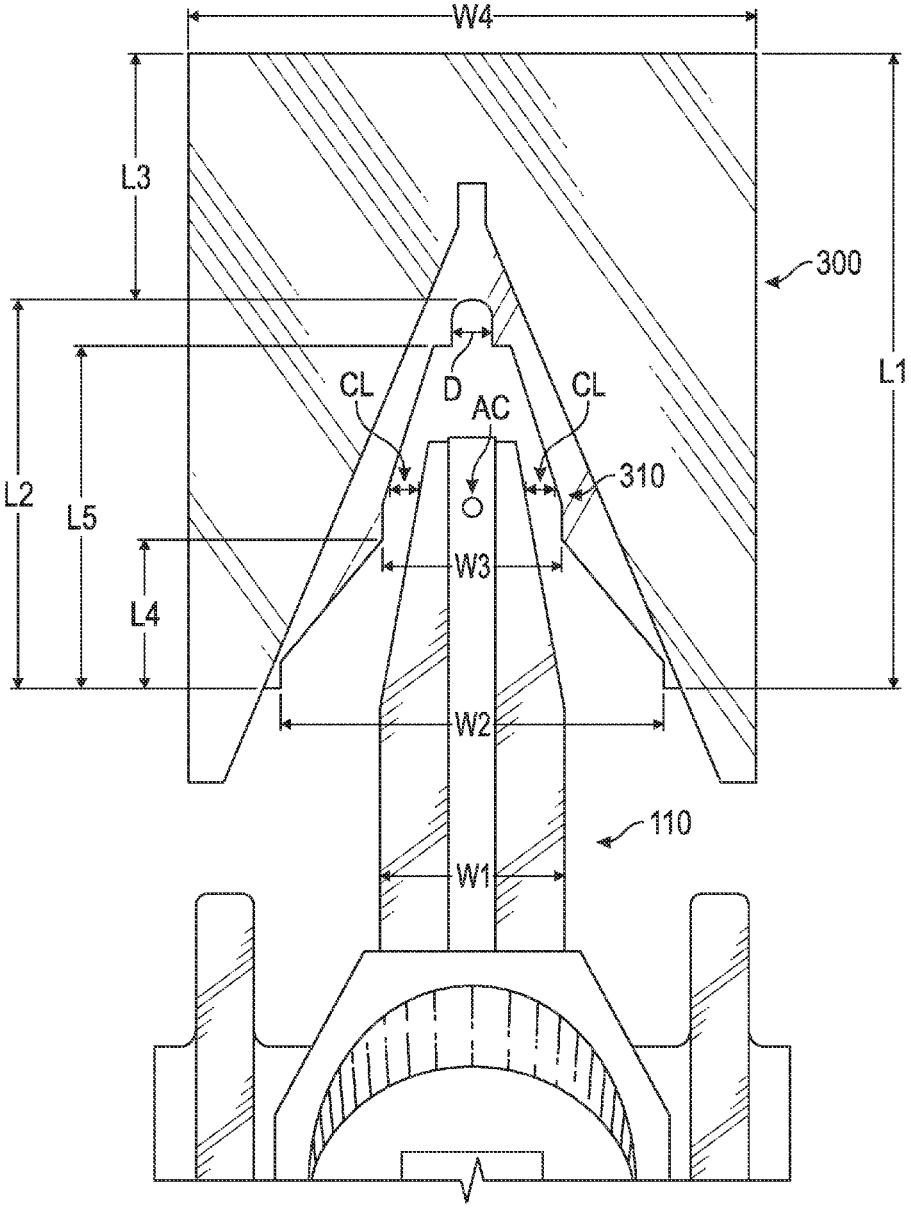
FIG. 5 illustrates internal geometry of a profiled arc splitter plate in accordance with an embodiment of the present disclosure in comparison with a splitter plate known in the art.

FIG. 5 illustrates internal geometry of a profiled arc splitter plate in accordance with an embodiment of the present disclosure in comparison with a splitter plate known in the art. The portion 310 of the body of the splitter plate 300 clearly indicates the additional body material in the vicinity of the arc column that is provided by the profiled arc splitter plate 300 of the present disclosure. This results in improved force on the arc. The main constraint when structuring the splitter plate is to ensure sufficient clearance between the stack of splitter plates and the movable contact when opening and closing of the contact. The profile also depends on the design and geometry of other components of the switch like the movable contact, arc runner, tips of the movable contact and the like.

FIG. 5 also illustrates the key dimensions and relationships that define the profiled arc splitter plate of the present disclosure, for a switch having a fixed contact and a movable contact having width W1. The plate comprises a body (not particularly shown) having a length L1 being a distance between a first set of two parallel planes defined at a proximal end and a distal end respectively with reference to the movable contact 110, and width W4 being a distance between a second set of two parallel planes, each plane of the second set being perpendicular to the planes of the first set, the body defining an operatively inverted substantially V-shaped recess having a center notch with diameter D in the range 2-4 mm, provided at the vertex of the recess, the vertex located at a distance L2 from the plane of the first set defined at the proximal end and a distance L3 from the plane of the first set defined at the distal end, the distance L1 being in the range 75-80% of the length L1, the distance L3 being in the range 20-25% of the length L1. The plate also comprises a first protrusion and a second protrusion defined on either side of the center notch along the inclined side walls of the recess, at a distance L4 and L5 respectively from the plane of the first set defined at the proximal end, the distance L4 being in the range 25-30% of the length L1, the distance L5 being in the range 60-65% of the length L1. The movable contact of the switch is displaceable through the recess without contacting the inclined side walls, in a spaced apart manner from the protrusions and the center notch, a clearance CL between the inclined side walls and the tip of the movable contact being in the range 3-4 mm and distance W2 being the maximum distance between the inclined side walls in the range 75-80% of the width W1.

The lengths L1 and L3 are decided by the magnetic saturation of the plate at maximum fault level. The distance L2 is maintained as short as possible considering required clearances. The protrusions are disposed to increase the magnetic material and to exert maximum attracting force on the arc. The diameter (D) of the center notch is designed in such way that it guides and pulls the arc directly into the center notch. The width W4 is optimized based on overall pitch of the switch and magnetic saturation level of plates as per fault rating of the switch. The distance W2 is finalized in such a way that it provides minimum force on the arc from the rear side (away from the center notch), so there will be maximum attracting force on the arc from the center notch only and the arc can move faster. This wide opening, as a result of the distance W2, also provides entry for cool air to enter into the arc chamber. This helps in cooling of the arc and also to develop pressure in the arc chamber.

Figure 6:
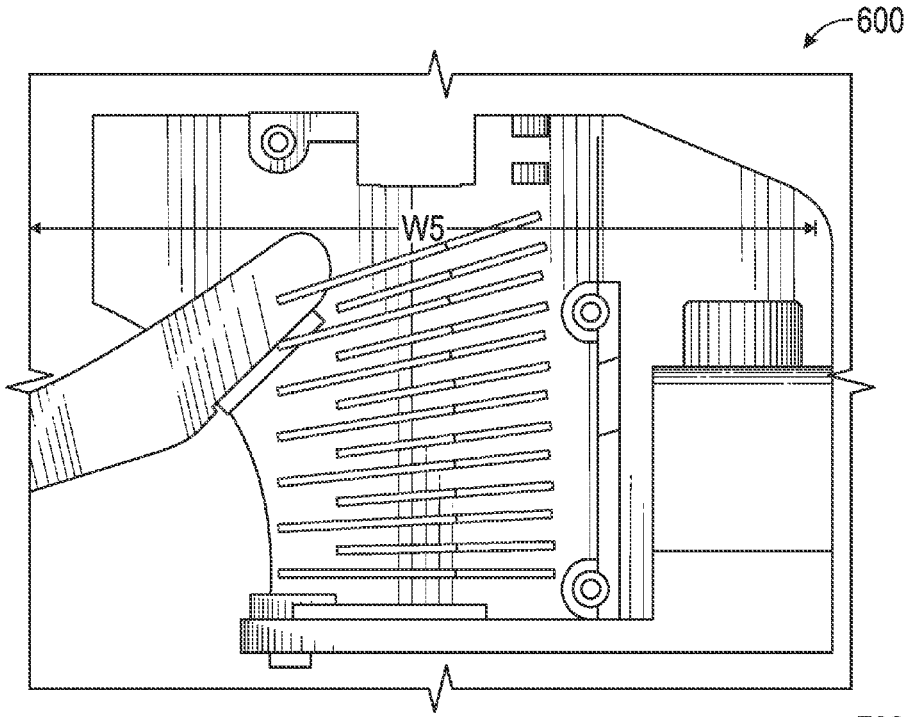
FIG. 6 illustrates an arc chamber assembly with splitter plates known in the art.
Figure 7:
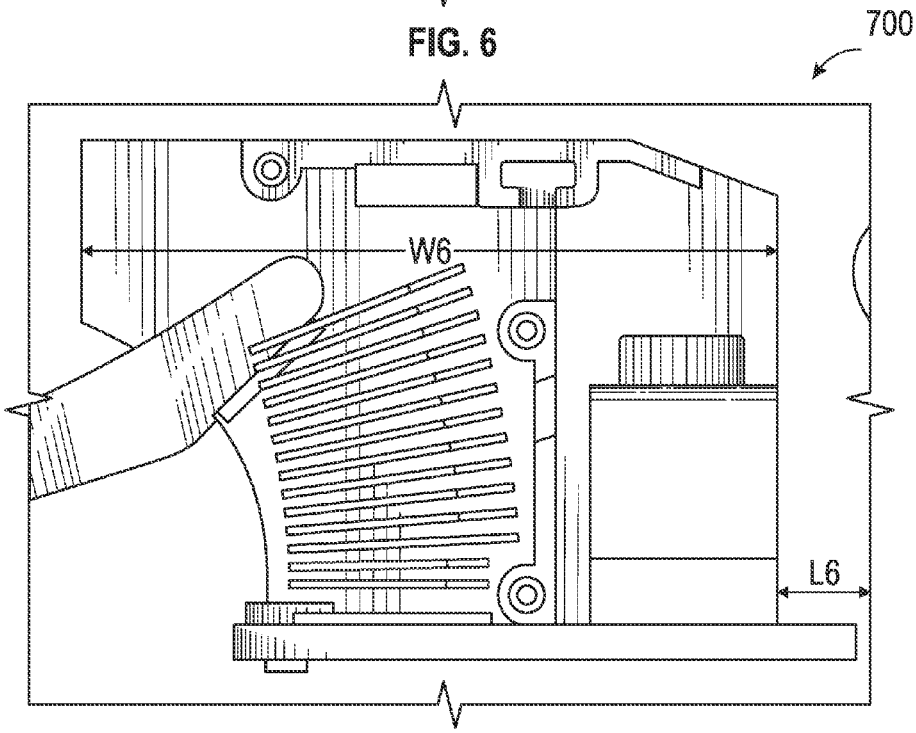
FIG. 7 illustrates an arc chamber assembly with profiled arc splitter plates in accordance with an embodiment of the present disclosure.

FIG. 6 illustrates an arc chamber assembly with splitter plates known in the art and FIG. 7 illustrates an arc chamber assembly with profiled arc splitter plates in accordance with an embodiment of the present disclosure.

W5 (shown in FIG. 6) represents the length of the fixed contact when conventional splitter plates are employed and W6 (shown in FIG. 7) represents the same when profiled arc splitter plates of the present disclosure are employed. It is clearly evident that the profiled arc splitter plates of the present disclosure as illustrated in FIG. 7 are compact, the stack has a smaller height and accordingly the overall size of the chute and hence the size of the switch is reduced. L6 represents the extra length of the fixed contact that was required when conventional splitter plates are employed. There is a considerable saving in copper costs due to the optimized compact size of the switch achieved by the profiled arc splitter plate of the present disclosure.

Experimental Data

Trial and experimentation on various splitter plates were conducted. The electromagnetic force generated for each profile was tabulated as given herein below.

| Profile | Improvement in force with respect to conventional splitter plate |
|---|---|
| Conventional splitter plate: No modification | Reference |
| Modified profile 1: with reduced total length of plate; center notch shifted towards the contacts; and a protrusion added along the inclined side wall of the recess on either side of the center notch | Increased by 32% |
| Modified profile 1: with added material in the vicinity of the arc column | Increased by 64% |
| Modified profile 2: with two protrusions added along the inclined side wall of the recess on either side of the center notch | Increased by 95% |
| Modified profile 2: with added material in the vicinity of the arc column regardless of clearance between plates and contact | Increased by 134% |
| Profiled arc splitter plate of the present disclosure: optimized according to sufficient clearances and maximum material in the vicinity of the arc column | Increased by78% |

The technical advancements offered by the present disclosure include the realization of:

- an arc splitter plate that provides increased electromagnetic forces on the arc;
- an arc splitter plate that reduces arcing time;
- an arc splitter plate having an optimized and compact profile;
- an arc splitter plate that provides enhanced cooling of the arc column;
- an arc splitter plate that improves the electrical life of a switch; and
- an arc splitter plate that is cost effective.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The use of the expression "at least" or "at least one" suggests the use of one or more elements or ingredients or quantities, as the use may be in the embodiment of the disclosure to achieve one or more of the desired objects or results.

The numerical values given of various physical parameters, dimensions and quantities are only approximate values and it is envisaged that the values higher or lower than the numerical value assigned to the physical parameters, dimensions and quantities fall within the scope of the disclosure unless there is a statement in the specification to the contrary.

Wherever a range of values is specified, a value up to 10% below and above the lowest and highest numerical value respectively, of the specified range, is included in the scope of the disclosure.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

We claim:

1. An arc splitter plate for a switch having a fixed contact and a movable contact, said arc splitter plate comprising:

a body having a length being a distance between a first set of two parallel planes defined at a proximal end and a distal end respectively with reference to the movable contact, and a width being a distance between a second set of two parallel planes, each plane of said second set being perpendicular to the planes of said first set, said body defining an operatively inverted substantially V-shaped recess having a center notch with diameter D in a range of 2-4 mm, provided at a vertex of said recess, said vertex located at a first distance from the plane of said first set defined at said proximal end and a second distance from the plane of said first set defined at said distal end, said first distance being in a range of 75-80% of said length, said second distance being in a range of 20-25% of said length; and a first protrusion and a second protrusion defined on either side of said center notch along an inclined side walls of said V-shaped recess, at a third and fourth distance respectively from the plane of said first set defined at said proximal end, said third distance being in a range of 25-30% of said length, said fourth distance being in a range of 60-65% of said length, the movable contact of the switch displaceable through said recess without contacting the inclined side walls, in a spaced apart manner from said protrusions and said center notch, a clearance between the inclined side walls and a tip of the movable contact being in a range of 3-4 mm and a maximum distance between the inclined side walls being in a range of 75-80% of the width.

2. The arc splitter plate as claimed in claim 1, wherein the location of said vertex of said recess and accordingly the location of said center notch is adapted to increase effective magnetic material in the vicinity of the arc column of the switch and provide predetermined clearance between said arc splitter plate and the movable contact.

3. The arc splitter plate as claimed in claim 1, wherein said arc splitter plate is provided with chamfers at an end proximal to said vertex of said recess.

4. The arc splitter plate as claimed in claim 1, wherein said arc splitter plate has a profile corresponding to a shape and geometry of a profile of at least one of arc runner, movable contact and tips of the movable contact.

5. The arc splitter plate as claimed in claim 1, wherein said arc splitter plate has a profile corresponding to at least one parameter selected from a group consisting of switch rating, short circuit rating of the switch, overload rating of the switch, saturation of magnetic flux lines during faults, location of said center notch and cooling of hot gases and arc column.

6. An arc chute comprising at least one stack of said arc splitter plates, as claimed in claim 1.

* * * * *